United States Patent [19]

Fischer

[11] Patent Number: 4,648,318

[45] Date of Patent: Mar. 10, 1987

[54] RUBBER BLANKET ATTACHMENT ARRANGEMENT FOR AN OFFSET ROTARY PRINTING MACHINE

[75] Inventor: Hermann Fischer, Augsburg, Fed. Rep. of Germany

[73] Assignee: M.A.N.-Roland Druckmaschinen Aktiengesellschaft, Augsburg, Fed. Rep. of Germany

[21] Appl. No.: 780,394

[22] Filed: Sep. 26, 1985

[30] Foreign Application Priority Data

Oct. 11, 1984 [DE] Fed. Rep. of Germany ..... 3437309

[51] Int. Cl.[4] ..... B41F 21/00; B41F 27/00; B24B 75/00

[52] U.S. Cl. ..... 101/415.1; 101/384; 101/378; 51/364

[58] Field of Search ..... 101/384, 386, 387, 377, 101/378, 372, 395, 415.1, 270; 51/364, 365, 366

[56] References Cited

U.S. PATENT DOCUMENTS

| | | | |
|---|---|---|---|
| 1,047,771 | 12/1912 | Egnor | 101/378 |
| 1,477,619 | 12/1923 | Wood | 101/395 |
| 1,662,232 | 3/1928 | Biemmer | 101/378 X |
| 1,773,949 | 8/1930 | Casto | 101/415.1 |
| 2,259,475 | 10/1941 | Kuether | 51/364 X |
| 2,480,373 | 8/1949 | Lacure | 101/378 |
| 2,627,229 | 2/1953 | Dietrich | 101/378 |
| 3,166,012 | 1/1965 | Hantscho | 101/220 |
| 4,133,146 | 1/1979 | De Cola | 51/364 X |
| 4,466,349 | 8/1984 | Bartlett | 101/415.1 X |

FOREIGN PATENT DOCUMENTS 1213430 3/1986 Fed. Rep. of Germany ..... 101/378

*Primary Examiner*—Edgar S. Burr
*Assistant Examiner*—James R. McDaniel
*Attorney, Agent, or Firm*—Frishauf, Holtz, Goodman & Woodward

[57] ABSTRACT

To reduce the width of the groove (6,7) within which the end portions of rubber blankets (14) of a blanket cylinder are attached, and thus prevent oscillations occurring due to roll-off of the groove against another cylinder, which may likewise have a groove, the rubber blanket is formed to have a reinforcing strip which is shorter than the axial dimension of the rubber blanket, the rubber blanket being formed with converging sides, the slot width of the groove adjacent the circumference of the cylinder being narrow in the end regions to have the width of only about twice the width of the thickness of the rubber blanket. In some constructions, the rubber blanket is a composite blanket formed of a substrate and an ink transferring cover; the end portion of the rubber blanket, which fits within the groove, can be left free of the ink transferring rubber cover so that the width of the slot at the end portion can be narrowed even further to only about twice the width of the substrate. The slot, or at least the central portion (11) thereof, can be slightly inclined with respect to a central axis (A-A) of the cylinder about which the blanket is to be stretched.

6 Claims, 4 Drawing Figures

RUBBER BLANKET ATTACHMENT ARRANGEMENT FOR AN OFFSET ROTARY PRINTING MACHINE

The present invention relates to offset rotary printing machines and more particularly to an arrangement to secure a rubber blanket on a rubber blanket cylinder and especially to an arrangement in which the rubber blanket is an essentially rectangular element which has its ends clamped in an axially extending slot by clamping devices located therein.

BACKGROUND

Rotary printing machines utilizing rubber blankets usually have blankets in which reinforcement strips extend over the width of the blanket—see, for example, U.S. Pat. No. 2,850,970, BRODIE, and corresponding German published patent application No. 1,124,051. The slot formed in the cylinder, extending essentially axially thereof, then must be wide enough to permit insertion of the reinforcement strip behind the portion of or end of the rubber blanket which had previously been inserted. Thus, the slot must have a width at the outer circumference of the blanket cylinder which corresponds to the thickness of the rubber blanket plus the thickness of the reinforcement strip. When the rubber blanket is stretched on the cylinder, a gap will remain since the blanket is thinner than the reinforcement strip. In operation, as the slot of one cylinder meets the slot of a counter cylinder, for example on perfecting printing if both rubber cylinders carry printed subject matter, the engagement force of the cylinders against each other drops abruptly as the gaps meet each other and then again rises abruptly. The run-over of the cylinder slots, thus, cause problems which cannot be entirely eliminated by the addition of bearer rings at one, or both ends of the blanket cylinder. It is unavoidable that oscillations within the cylinder will result. This is particularly noticable when both cylinders have cylinder slots although, if only one cylinder has a cylinder slot, for example for prime printing only, the drop-off of engagement force of the rubber blanket cylinder with the counter or impression cylinder is also noticable.

THE INVENTION

It is an object to improve a rotary printing maching having at least one rubber blanket cylinder on which a blanket is stretched, the end portions of which are retained in suitable clamps—as well known—for located in an axially extending slot, and in which the undesirable effects of short-time abrupt changes in printing impression force between the rubber blanket cylinder and a coacting cylinder is effectively eliminated.

Briefly, the reinforcement strip at the end of the rubber blanket which is last inserted, for example, the trailing end, and which may be referred to as the second end of the rubber blanket is foreshortened, that is, is made shorter than the width of the edge along which it extends. The edges of the rubber blanket starting from the reinforcement strip, flare outwardly such that, when the rubber blanket is stretched about the cylinder, essentially the entire axial length of the cylinder is covered by the rubber blanket—the flaring portion being located within the clamping slot on the cylinder. The width of the slot is non-uniform about the axial length thereof, being wide enough to permit passage of the reinforcement strip in the region where it is present, but narrowing at the ends to permit passage of only the rubber blanket with just a tiny bit of clearance, so that, in operation, effectively there will be no gap at the end portions of the cylinder at the edges of which abrupt changes in impression force will occur.

The system has the advantage that it can be readily implemented, the cylinders can be easily made with the slots of differential widths at the circumferences thereof, and the blanket construction need not deviate from existing blanket construction. In accordance with a preferred feature of the invention the rubber covering of the blanket is omitted at the flared end portions of the blanket, thus, permitting additional reduction in the width of the axially extending blanket clamping slot.

DRAWINGS

DETAILED DESCRIPTION

Figure 4:
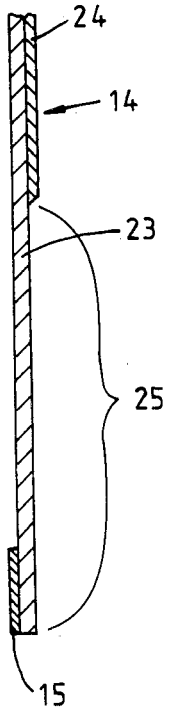
FIG. 4 is a cross-sectional view through the blanket taken along line IV—IV of FIG. 2.
Figure 1:
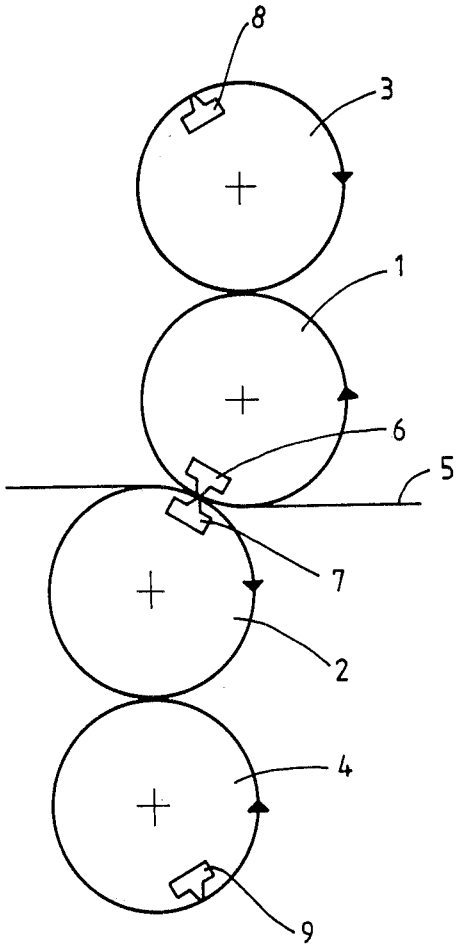
FIG. 1 is a schematic side view of an offset rotary printing machine, arranged for perfecting printing, that is, on the prime and reverse side of a substrate.

The schematic representation of FIG. 1 of an offset rotary printing machine illustrates two blanket cylinders 1, 2, receiving ink and subject matter from plates 3,4. A web 5, typically of paper, is printed on both sides of the web, that is, the machine is set for perfecting printing. Each one of the blanket cylinders 1,2 has an axially extending groove 6,7 in which clamping and stretching devices are located—as well known and which may be of any suitable construction—capable of retaining a rubber blanket on the cylinder. The plate cylinders 3,4, likewise have grooves 8,9 to receive plates.

Figure 3:
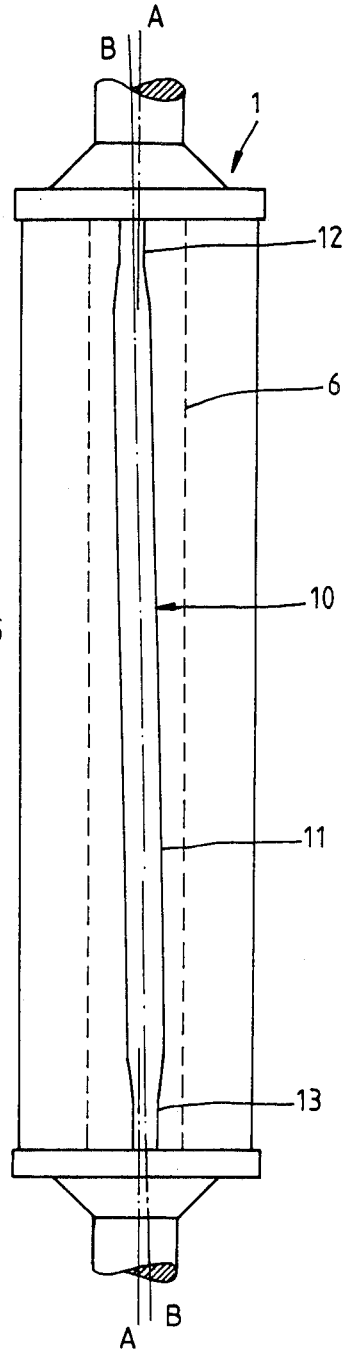
FIG. 3 is a schematic top view of a blanket cylinder suitable for use with the blanket of FIG. 2.

As best seen in FIG. 3, the blanket cylinder 1 is formed with a narrow approximately axial extending slot 10, which permits access to the clamping elements within the slot. The slot 10 has a central region 11 which is wider, at least at the circumferential region, than the end regions or zones 12,13. The end regions or zones 12,13, thus are substantially narrower than the central region 11. The slot 10, in FIG. 3, is shown greatly enlarged; the figure is not to scale, for better illustration of the present invention.

Figure 2:
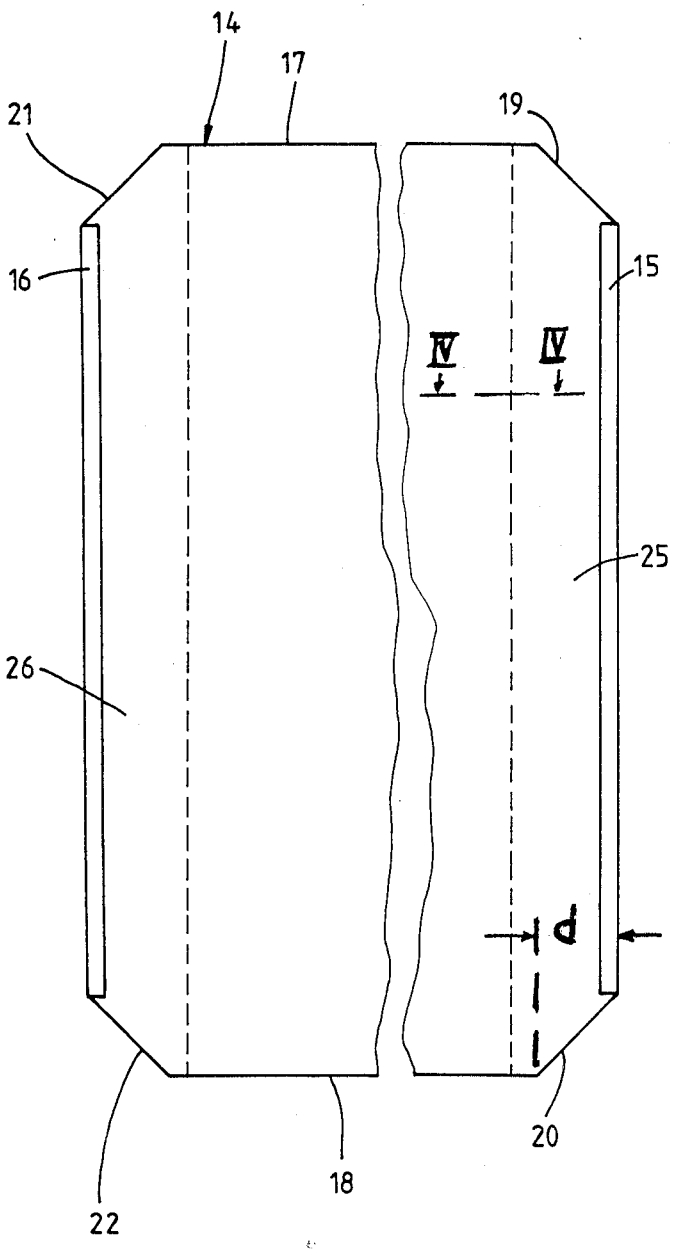
FIG. 2 is a top view of a rubber blanket suitable for use in the arrangement in accordance with the invention.

A rubber blanket 14—FIG. 2—is stretched on the cylinder 1. The rubber blanket has first and second edges, which, usually, will be leading and trailing edges; each one is reinforced by a reinforcement strip 15,16, respectively.

In accordance with a feature of the invention, the axial length of the reinforcement strips 15,16 is shorter than the width of the rubber blanket 14. Preferably, the distances from the ends of the reinforcement strips 15,16 to the associated side edges 17,18 of the blanket are equal, that is, the reinforcement strips are located centrally with respect to the widths of the blanket 14. The ends of the reinforcement strips 15,16 are connected by a flared portion 19,20 and 21,22, respectively of the rubber blanket 14, leading to the side edges 17,18 of the blanket 14, respectively, as clearly seen in FIG. 2. It is, of course, also possible to make only one of the reinforcement strips, preferably the one which is first inserted into the cylinder—in accordance with the cylinder arrangement—of the same width of the rubber blanket, and to make only one of the ends with a foreshortened reinforcement strip. The front or first edge which is inserted is that edge which is first placed into the axial slot 10; the second edge is that one which is placed last.

Many blankets 14 are of multilayer construction, having, for example, a base or substrate layer 23, for example, made of woven textile material, which can be impregnated and otherwise reinforced, on which an ink transferring cover layer 24, for example, rubber, is attached. The layers, typically, are bonded together. If a blanket is made with this construction, then, suitably, and in accordance with the feature of the invention, the end portions 25,26 which are within the slot 10 of the blanket cylinder when the blanket is installed, will be formed only of the textile substrate. This, has the additional advantage to be able to further reduce the width of the slot 10.

The end zones or regions 12,13 of the slot 10 in the cylinder 1 are so dimensioned that their widths is about equal to twice the thickness of the rubber blanket 14. When the rubber blanket is stretched over the cylinder, the end regions 12,13 are thus filled by the material of the rubber blanket. The central region 11 of the slot 10 is dimensioned with such a width that, in addition to one layer of the rubber blanket, the second reinforcement strip 16 may be introduced into the slot.

In a typical arrangement, a rubber blanket will have a thickness of 1.9 mm, and the reinforcement strip a thickness of 1 mm. The width of the cylinder in the edge regions 12,13, then may have a thickness of between 3.8 to 4 mm, that is, leaving a fraction of a millimeter as additional clearance and to accept tolerances. The central region 11 will have a width of about 5 to 6 mm.

Some arrangements utilize rubber blankets which are comparatively stiff and there are small transition radii between the slot 10 and the cylindrical circumferential surface of the blanket cylinder. In such arrangements, the slot width may be extended by 1 to 2 mm in both the dimensions of the end zones as well as the dimensions of the central zones.

In accordance with a feature of the invention, a rubber blanket is used in which end portions 25,26 are made only of the textile substrate 23. In such an arrangement, the aforementioned widths of the slot 10 can be decreased by the thickness of the cover layer 24.

The length of the central region 11 corresponds at least to and approximately preferably to the length of the reinforcement strip 16. As best seen in FIG. 3, the transition between the central portion 11 and the end portions 12,13 may be slightly inclined.

Both blanket cylinders 1,2, and the blankets thereon can be identical, for example, both constructed as described in connection with the cylinder 1.

OPERATION

Upon printing, the blanket cylinders 1,2, will roll off against each other. The engagement force with which two cylinders roll off against each other is transferred entirely between the blanket cylinders if they are operating without bearer rings; if operating with bearer rings, most of the force is transferred between the blanket of the blanket cylinder. When the slots 10 of the attachment grooves 6,7—see FIG. 1—meet each other, the engagement force between the blanket cylinders can continue to be transferred within the edge regions 12,13 of the slots 10 by the blankets themselves, since the edge regions 12,13 are essentially entirely filled. Thus, collapse of the cylinders towards each other due to the meeting of the grooves, and the resulting tendency to oscillate of the cylinders is effectively avoided. This engagement in the edge zones, upon suitable stiffness of the cylinders, is effective throughout the axial length of the cylinders. At the transition zones between the edge regions 12,13 and the central region 11, forceful engagement after passing the cylinder 10 will occur smoothly and not abruptly, which, also, acts to reduce any tendency of the cylinders to oscillate or vibrate.

In accordance with a feature of the invention, the effect can be further enhanced by slightly inclining the edge regions 12,13 with respect to the central region 11 of the slot. By making the central region of the slot 10 slightly inclined—see the axis B—B of FIG. 3—with respect to the central rotary axis A—A of the cylinder 1, the end portions 12,13 will meet the respective cylinders against which they roll off slightly out-of-phase so that any remaining narrow gap, for example, due to tolerances, in the edge zones will not meet the gap of the mating cylinder in the edge zones at the same time. The slightly inclined central region 11 of the slot 10 also causes a phase shift of transient forces acting between the cylinders as the gaps pass each other. The angle of inclination of the central portion 11 of the gap can be very small. The end portions 12,13, preferably, extend axially with respect to the cylinder 1.

Various changes and modifications may be made within the scope of the inventive concept.

In an operating example, and with a cylinder having an axial length of 730 mm on which a blanket having a width between the edges 17,18 of 630 mm was stretched, had two reinforcement strips 15,16 of length attached thereto. The distance d from the end edge of the edge strip 15 to termination of the inclined or flared walls 19,20 was 70 mm resulting in an angle of the respective flared portions 19,20 with respect to the side edges 17,18 of about 45°. The angle of inclination between the axes B and A (FIG. 3) was 0.15°.

The foregoing dimensions are not critical and are merely an example of a suitable structure operating entirely satisfactorily.

I claim:

1. In combination with a printing machine, a rubber blanket (14) and a rubber blanket cylinder (1,2), for transferring print images, under pressure, onto a printing medium, formed with an, approximately axially, extending groove (6,7) for receiving and clamping end edges (25,26) of said rubber blanket (14) therein, an attachment arrangement for the rubber blanket (14), the rubber blanket being formed with a reinforcing strip (15,16) at both first and second end edges of the rubber blanket, and said groove (6,7) having a slot (10), a central zone (11) and two end zones (12,13) disposed at respective ends of said blanket cylinder, said groove being narrower in said end zones than in said central zone, whereby the effective width of said groove, when said blanket is clamped therein, is reduced, thereby minimizing both oscillation of said cylinder toward the printing medium when said groove is against said printing medium, and the linear portion of said printing medium which must be left free of print images, due to pressure reduction caused by said groove, said reinforcement strip (15) along at least one of the end edges (25) of said rubber blanket (14) being shorter than the distance between lateral edges (17,18) of the rubber blanket (14);

the rubber blanket (14) being formed with flared portions (19, 20) joining the lateral edges of said rubber blanket to the end edges, said flared portions starting from the full width of the rubber blanket at approximately the position where the blanket meets the circumference of the cylinder, said flared portions extending towards the shorter reinforcement strip, and said end zones (12,13) of said groove receiving the flared portions of the rubber blanket, free from the reinforcement strip, and the central zone (11) having a width and an axial length just sufficient to permit passage of the shorter reinforcement strip (15) radially therethrough, for insertion of the reinforcement strip through the slot into the rubber blanket cylinder.

2. Attachment arrangement according to claim 1, wherein the width of the end zones (12,13) of the slot (10) is approximately twice the thickness of the rubber blanket (14).

3. Attachment arrangement according to claim 1, wherein the slot (10) has a center line (B—B) which extends at the small angle of inclination with respect to the central axis (A—A) of the blanket cylinder (1).

4. Attachment arrangement according to claim 3, wherein the slot (10) has a central portion extending under said small angle of inclination with respect to the central axis (A—A) of the blanket cylinder;

and the end zones (12,13) extend approximately parallel to the central axis (A—A) of the blanket cylinder.

5. Attachment arrangement according to claim 3, wherein the rubber blanket includes a base substrate layer (23) and an ink transferring top layer (24);

said end edges (25,26) of the rubber blanket are stretched about the cylinder (1,2) to fit within the slot (10) in the cylinder and are formed only of the substrate layer and the reinforcement strip.

6. Attachment arrangement according to claim 5, wherein the widths of the end zones (12,13) of the slot (10) are just slightly wider than twice the thickness of the substrate layer.

* * * * *